US006117052A

United States Patent [19]

Frost et al.

[11] Patent Number: 6,117,052

[45] Date of Patent: Sep. 12, 2000

[54] AEROBIC EXERCISE MACHINE WITH LATERAL SWINGING CAPABILITY

[75] Inventors: Howard M. Frost, Euless, Tex.; George D. Stickler, Shorewood, Minn.

[73] Assignee: Bollinger Industries, L.P., Grand Prairie, Tex.

[21] Appl. No.: 09/307,582

[22] Filed: May 7, 1999

[51] Int. Cl.[7] ..... A63B 22/00; A63B 21/00

[52] U.S. Cl. ..... 482/52; 482/907; 482/71

[58] Field of Search ..... 482/51, 52, 53, 482/57, 70, 71, 148, 907

[56] References Cited

U.S. PATENT DOCUMENTS

| | | | |
|---|---|---|---|
| 3,731,919 | 5/1973 | Schurch . | |
| 3,756,595 | 9/1973 | Hague | 482/51 |
| 4,396,189 | 8/1983 | Jenkins | 482/51 |
| 4,650,184 | 3/1987 | Brebner . | |
| 4,861,023 | 8/1989 | Wedman | 482/51 |
| 4,911,430 | 3/1990 | Flament . | |
| 5,336,141 | 8/1994 | Vittone | 482/51 |
| 5,419,747 | 5/1995 | Piaget et al. | 482/51 |
| 5,536,225 | 7/1996 | Neuberg et al. | 482/71 |
| 5,584,780 | 12/1996 | Lin | 482/52 |
| 5,792,027 | 8/1998 | Gvoich | 482/52 |
| 5,906,561 | 5/1999 | Lin | 482/52 |

*Primary Examiner*—Stephen R. Crow

*Attorney, Agent, or Firm*—Felsman, Bradley, Vaden, Gunter & Dillon, L.L.P.

[57] ABSTRACT

An aerobic exercise device for performing lateral swinging or swaying motions is disclosed. The device has a base with an upright tubular steel frame and integral handles. A swing assembly or pendulum is pivotally suspended from an upper portion of the frame. The pendulum comprises a pair of vertical bars which are pivotally joined to a short horizontal bar at their lower ends. A pair of foot pad assemblies are pivotally mounted to the horizontal bar. Each foot pad has a shock absorber mounted between it and its adjacent vertical bar for creating resistance to the motion of the pendulum. The user grips the a handle with each hand and places one foot on each foot pad. By moving the legs and lower torso from side to side, the user can exercise by swaying or swinging the pendulum from side to side while the frame remains stationary.

13 Claims, 5 Drawing Sheets

AEROBIC EXERCISE MACHINE WITH LATERAL SWINGING CAPABILITY

TECHNICAL FIELD

This invention relates in general to fitness equipment and in particular to an aerobic exercise machine which utilizes lateral swinging motions.

BACKGROUND ART

In the prior art, there are numerous aerobic exercise machines which are designed to support the full weight of the user while in operation. These include treadmills, bicycling devices, stepping machines, skiing simulators and the like. Devices utilizing the latter concept are similar to "air walker" type products except for the use of limited side to side motion instead of a front-to-back walking or striding type motion.

One type of skiing simulator, described in U.S. Pat. No. 4,396,189, shows an exercising and skiing simulating machine which is capable of pivotal swinging or swaying motions. That machine has a horizontal rotating platform (28, FIGS. 2 and 3) and two boot support surfaces (50, 51, FIG. 3). The boot support surfaces are rotatably suspended from the platform by horizontal axes (55, FIG. 18) and vertical axes (52, FIG. 2). The boot support surfaces are also offset vertically downward relative to the horizontal axes by a distance equal to the vertical distance from the boot sole to the ankle joint of a person. Although this design is workable, an improved aerobic exercise machine with enhanced lateral movement capability is desirable.

SUMMARY OF THE INVENTION

An aerobic exercise device for performing lateral swinging or swaying motions is disclosed. The device has a base with an upright tubular steel frame and integral handles. A swing assembly or pendulum is pivotally suspended from an upper portion of the frame. The pendulum comprises a pair of vertical bars which are pivotally joined to a short horizontal bar at their lower ends. A pair of foot pad assemblies are pivotally mounted to the horizontal bar. Each foot pad has a mechanical dampener mounted between it and its adjacent vertical bar for creating resistance to the motion of the pendulum. The user grips the a handle with each hand and places one foot on each foot pad. By moving the legs and lower torso from side to side, the user can exercise by swaying or swinging the pendulum from side to side while the frame remains stationary.

BEST MODE FOR CARRYING OUT THE INVENTION

Figure 1:
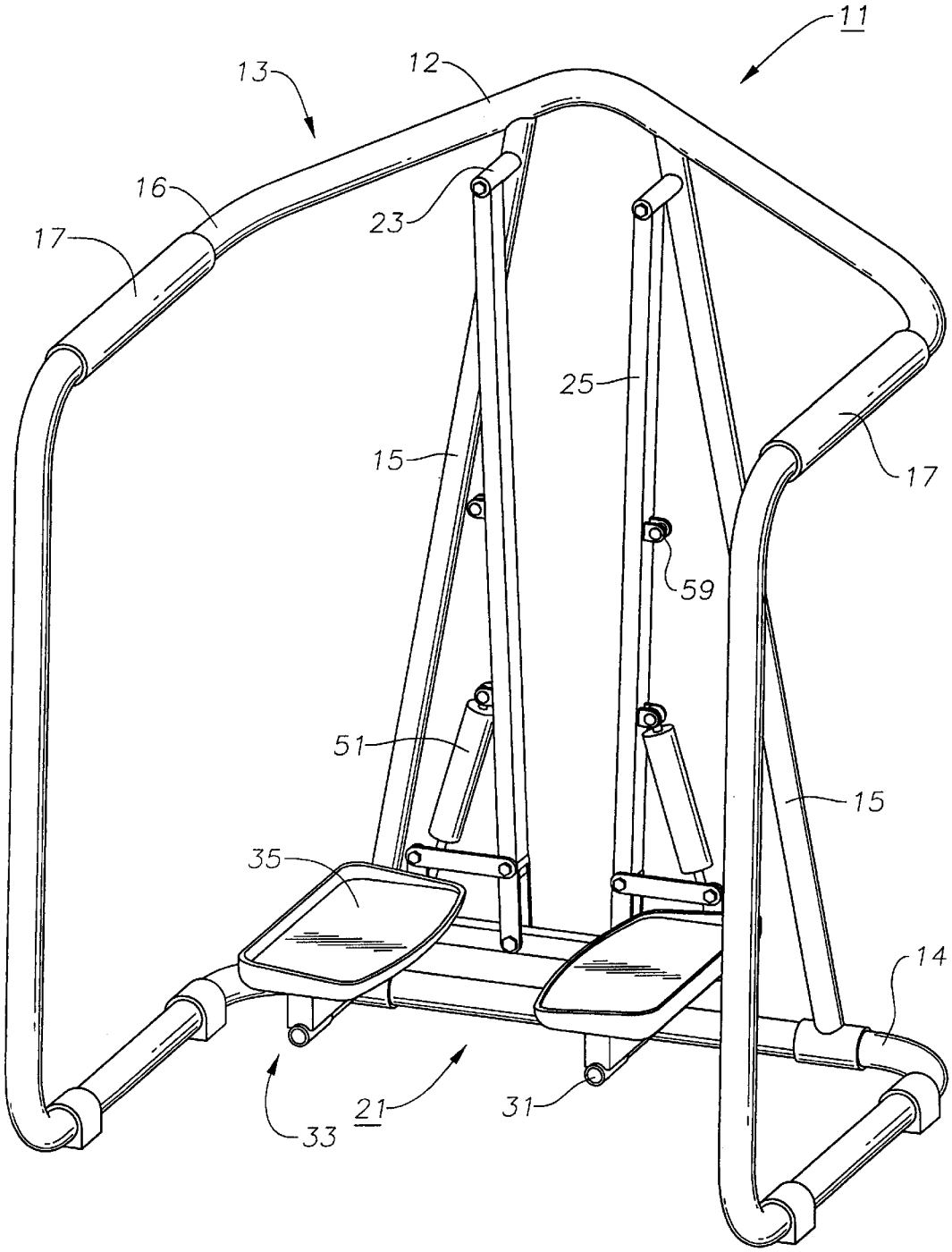
FIG. 1 is a front isometric view of an exercise machine constructed in accordance with the invention.
Figure 2:
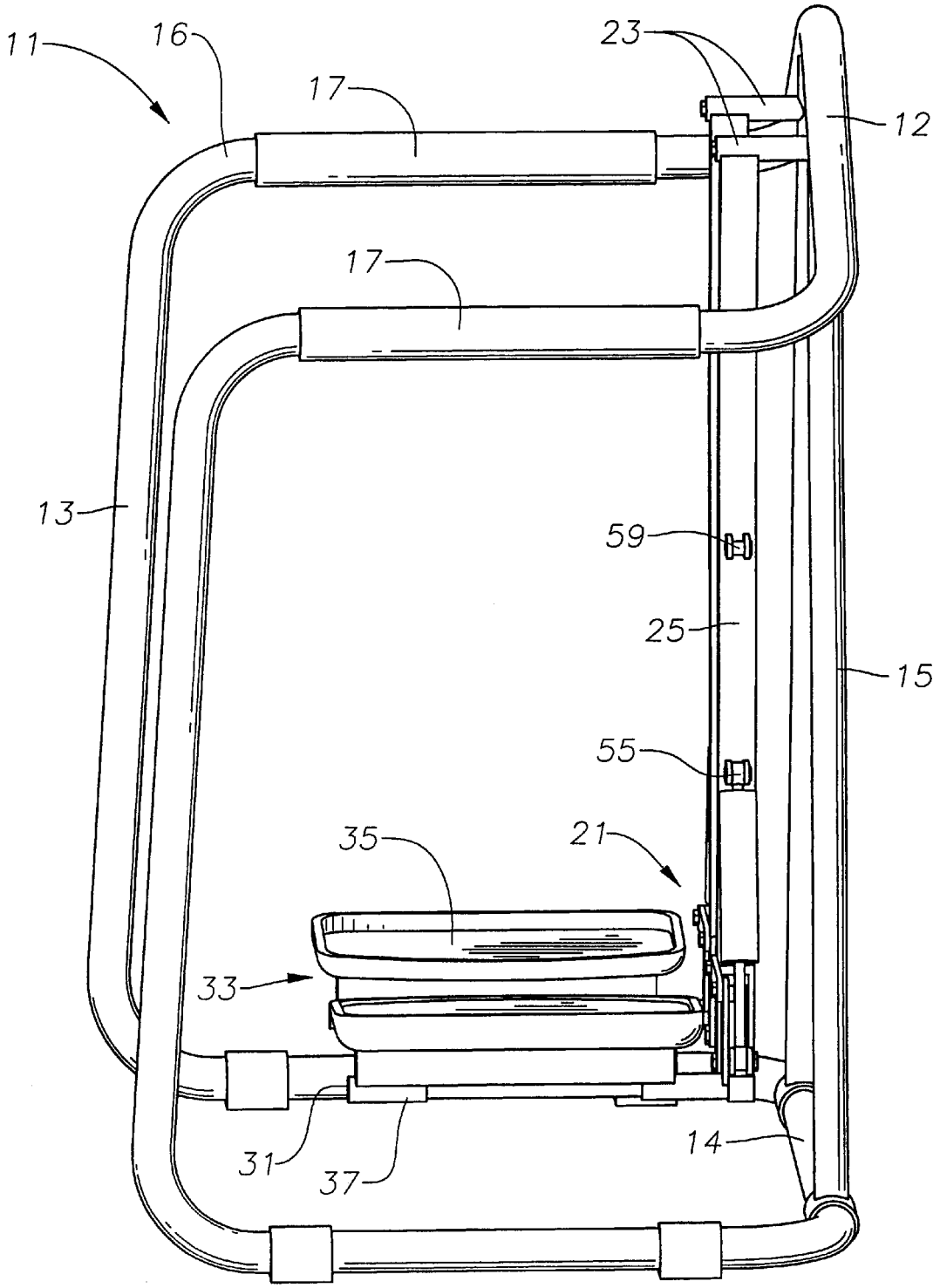
FIG. 2 is a side view of the machine of FIG. 1.

Referring to FIGS. 1 and 2, an aerobic exercise machine 11 is shown. Machine 11 has a tubular steel frame 13 which is contoured for comfort and ease of use while enhancing its strength and stability. The rearward side of frame 13 has a pair of vertically diagonal support tubes 15 which extend between its upper and lower members 12 and 14, respectively. Other than support tubes 15, frame 13 is substantially continuous in its construction and appearance. Each lateral side frame 13 has an integral handle 17 which extends along its upper horizontal member 16. In the embodiment shown, handles 17 have a textured surface and/or padding for improved grip and comfort for the user.

Figure 3:
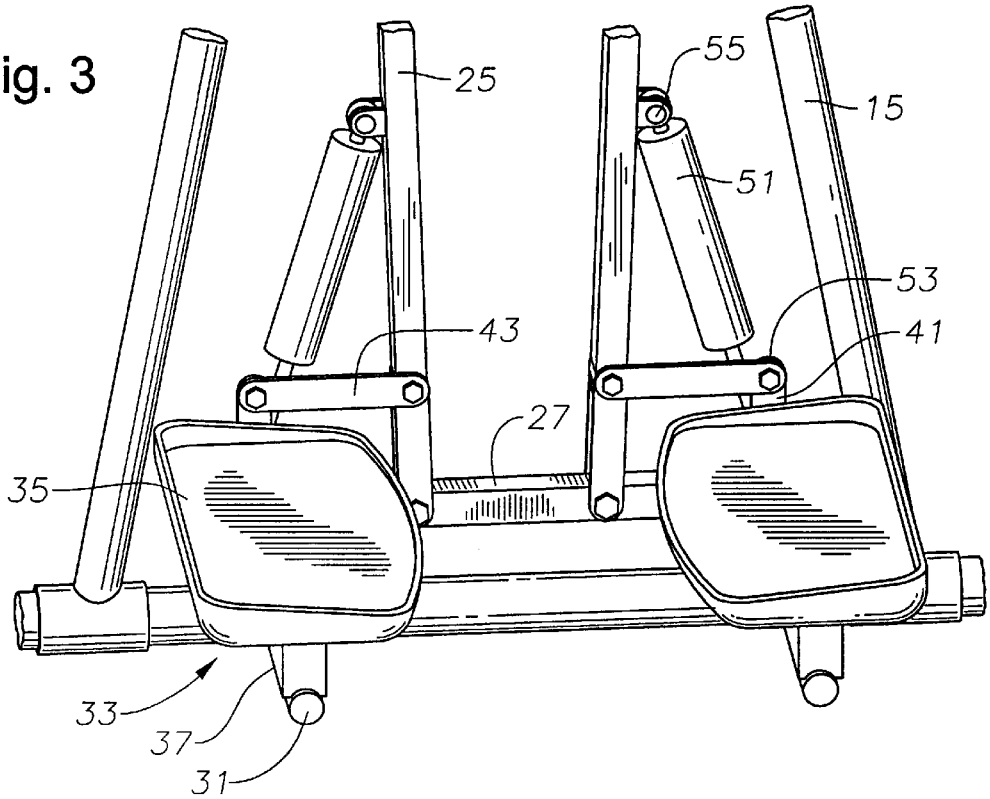
FIG. 3 is an enlarged front view of a lower portion of the machine of FIG. 1.

Machine 11 has a central swing assembly or pendulum 21 suspended from a pair of horizontal upper axles 23 near the tops of support tubes 15. Upper axles 23 are substantially parallel to one another and extend forward a short distance from support tubes 15. Pendulum 21 has a pair of substantially vertical bars 25 if whose upper ends are pivotally mounted to upper axles 23. As shown in FIG. 3, the lower ends of vertical bars 25 are pivotally mounted to a laterally disposed horizontal bar 27. Note that the separation between the upper ends of vertical bars 25 is slightly greater than the separation between the lower ends of vertical bars 25. Horizontal bar 27 extends laterally beyond its intersection point with each vertical bar 25. Horizontal bar 27 remains substantially horizontal throughout a range of motion which will be described below.

Figure 4:
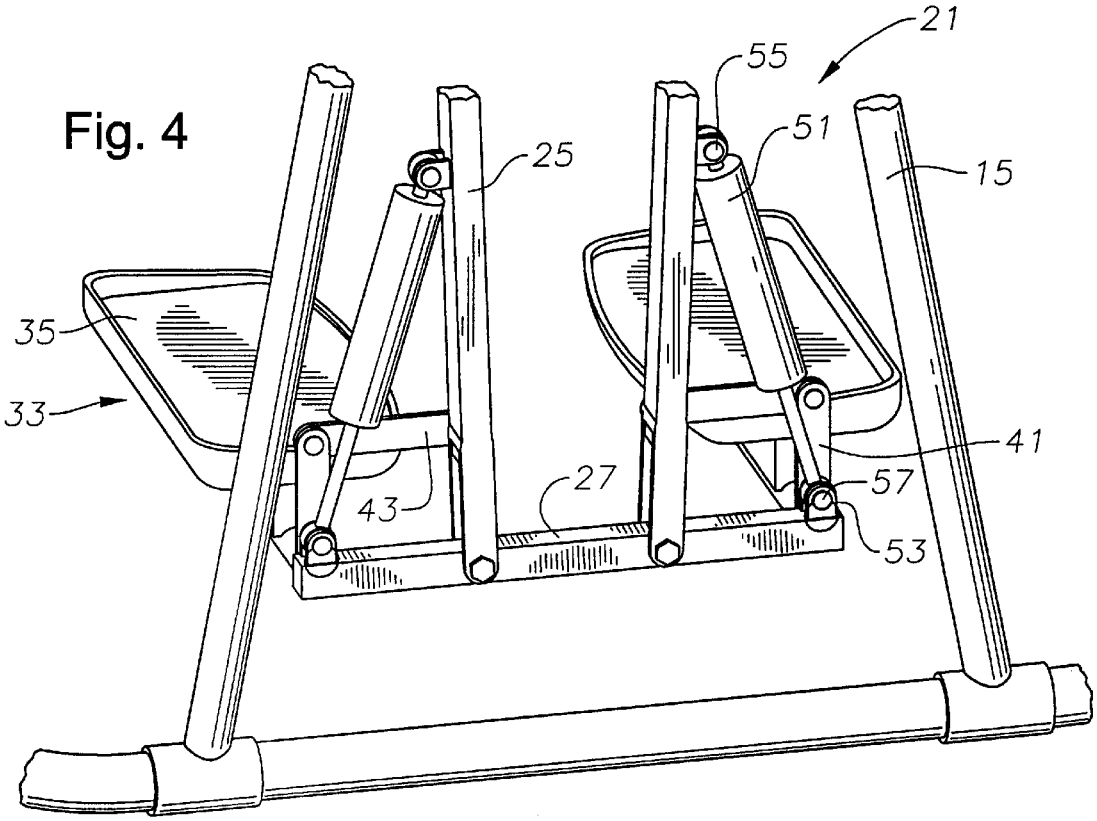
FIG. 4 is an enlarged rear view of a support assembly of the machine of FIG. 1.
Figure 5:
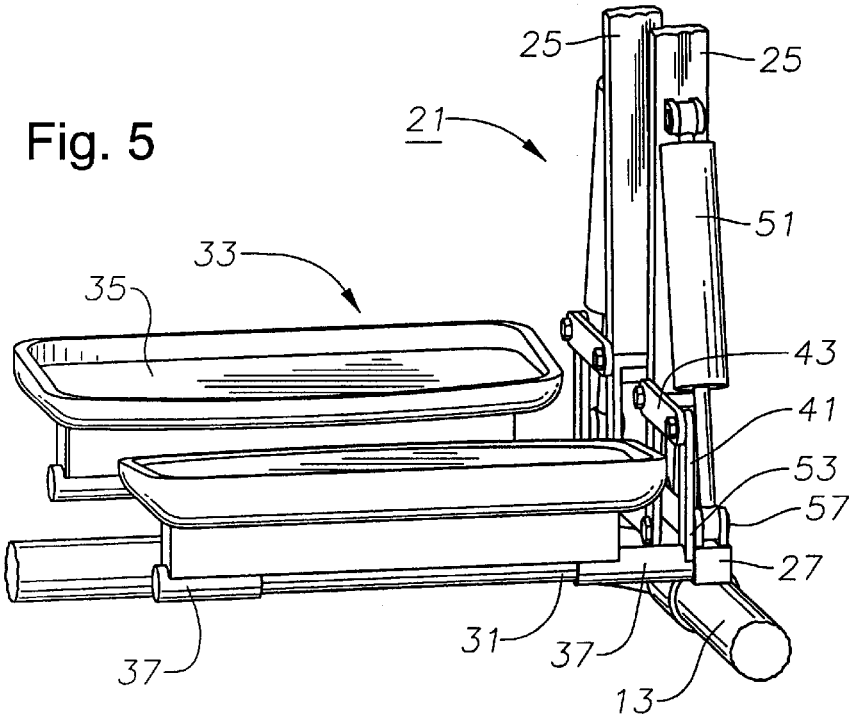
FIG. 5 is an enlarged side view of the support assemblies of the machine of FIG. 1.
Figure 6:
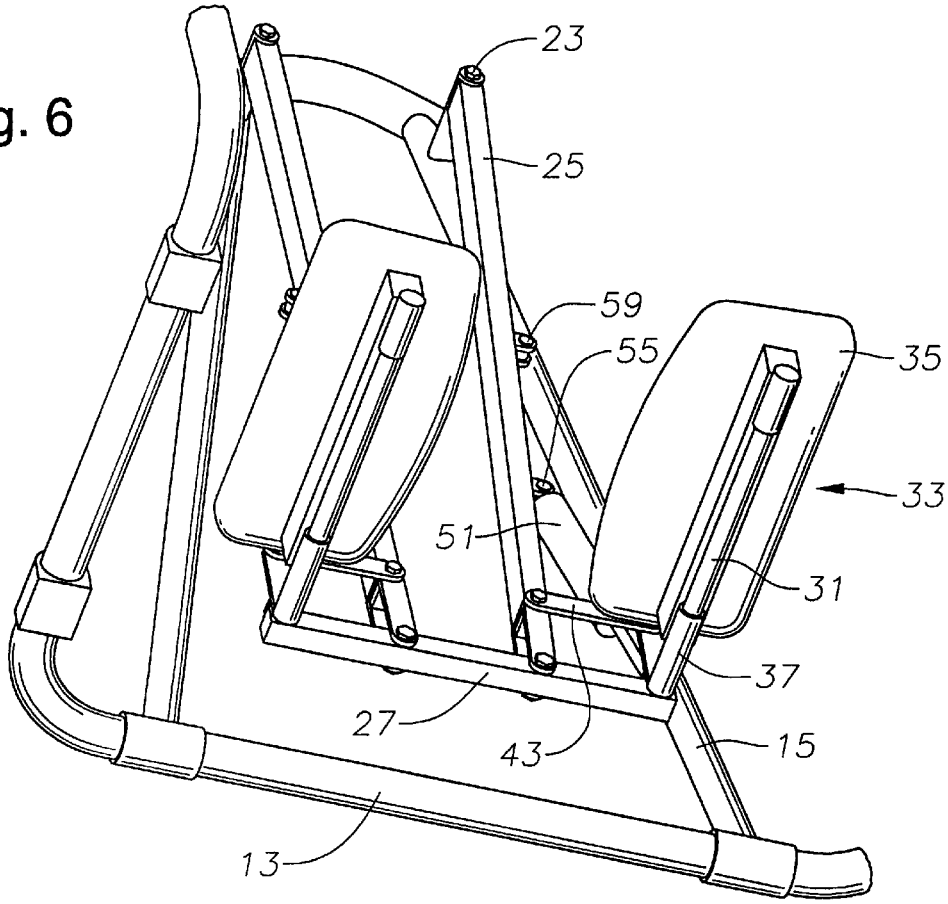
FIG. 6 is an enlarged bottom view of the machine of FIG. 1.

As shown in FIGS. 5 and 6, a lower axle 31 extends horizontally forward from each end of horizontal bar 27 such that lower axles 31 are perpendicular to horizontal bar 27. Lower axles 31 are also substantially parallel to and much longer than upper axles 23. A foot support assembly 33 is pivotally mounted to each lower axle 31. Each foot support assembly 33 comprises an oversized, planar foot platform 35 having a pair of downward extending, coaxial tubular collars 37. In the embodiment shown, foot platforms 35 have a textured upper surface and/or padding for improved footing and comfort for the user. Collars 37 are provided for slidably engaging lower axles 31. A linkage arm 41 (FIGS. 4 and 5) extends rigidly upward from the rearward collar 37 of each foot support assembly 33. Linkage arms 41 are fixed from movement relative to their respective foot support assemblies 33. A short linkage member 43 (FIGS. 3 and 4) is pivotally attached to and extends horizontally between the upper end of each linkage arm 41 and its adjacent vertical bar 25. As shown in FIG. 3, each linkage member 43 is attached to its respective vertical bar 25 at a point which is located a short distance above the adjacent pivot point between its vertical bar 25 and horizontal bar 27.

Each foot support assembly 33 is also provided with a mechanical dampening device or shock absorber 51. The lower or piston end of each shock absorber 51 is pivotally mounted to an adjacent end feature 53 of horizontal bar 27. End features 53 are located just above lower axles 31. The upper or cylinder end of each shock absorber 51 is pivotally mounted to an attachment point 55 on the lateral side of its adjacent vertical bar 25. Note that the lower ends of shock absorbers 51 may be readily detached from end features 53 with quick-release pins 57 (FIGS. 4 and 5). After the lower ends of shock absorbers 51 are detached, they can be secured in an inverted position (FIG. 1) by reattaching them with pins 57 to upper attachment points 59 on vertical bars 25. Shock absorbers 51 are not functional when they are in this secured position.

Figure 7:
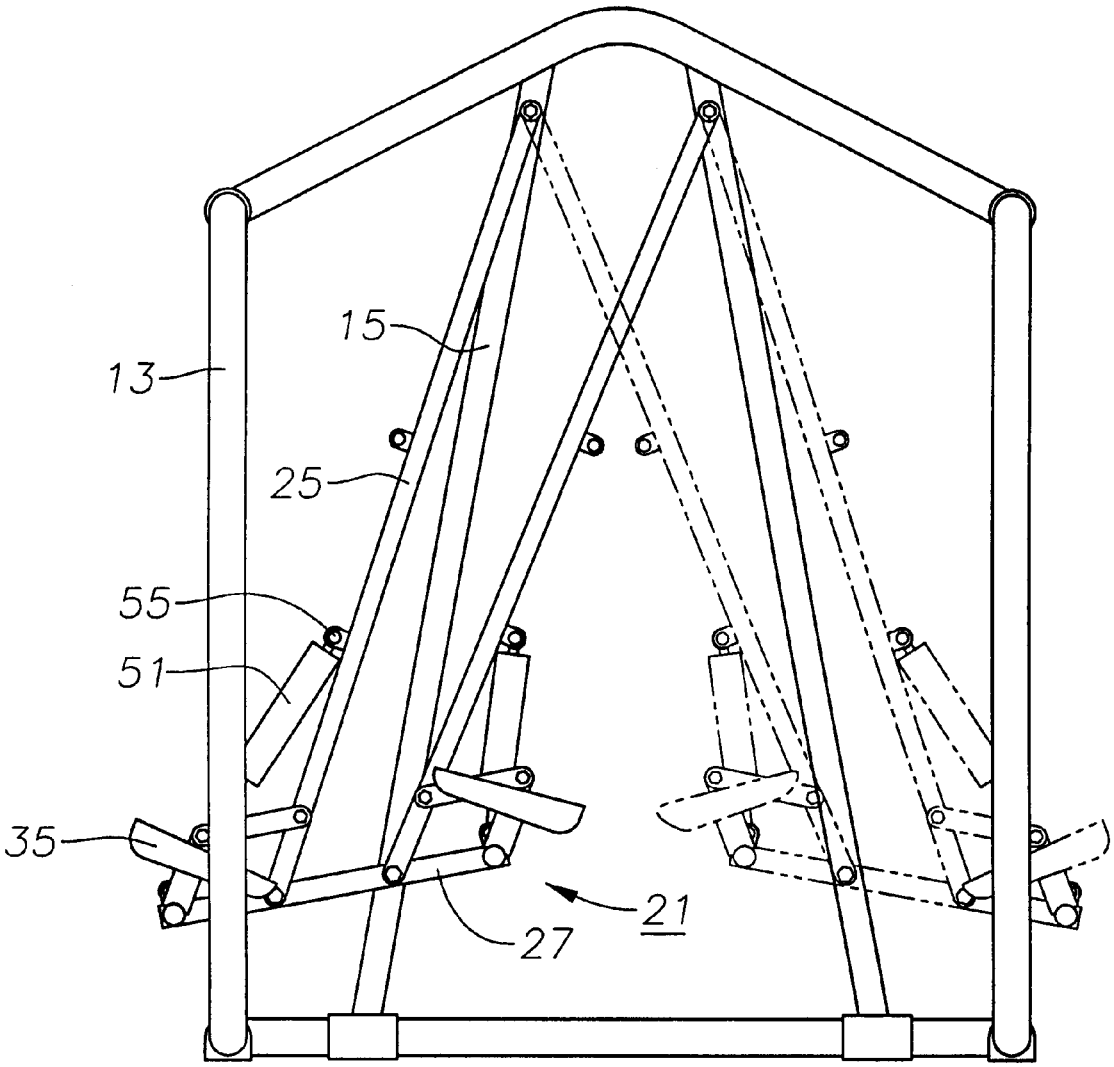
FIG. 7 is a front isometric view of the machine of FIG. 1 in operation.

In operation, a user (not shown) grips a handle 17 with each hand and places one foot on each foot platform 35. The user may face toward or away from machine 11. By moving the legs and lower torso from side to side in unison, the user can exercise by swinging or swaying pendulum 21 laterally from side to side while holding frame 13 which remains stationary (FIG. 7). The user controls the speed, amplitude and duration of each swing. During operation, vertical bars 25, linkage arms 41 and shock absorbers 51 remain substantially vertical, while horizontal bar 27, foot platforms 35 and linkages 43 remain substantially horizontal. However, as shown in FIG. 7, the various linkage elements which connect foot platforms 35 to pendulum 21 synchronize the movements of foot platforms 35 while maintaining foot platforms 35 at anatomically correct angles relative to the torso of the user throughout their range of motion.

When shock absorbers 51 are in their normal or functional positions (FIG. 7), they are alternately extended and retracted by the relative motion between vertical bars 25 and horizontal bar 27. Shock absorbers 51 give resistance to motion in both directions. For example, in FIG. 7 the shock absorber 51 on the left is being compressed while the one on the right is being extended. These manipulations are reversed as pendulum 21 swings to the opposite side. The maximum amplitude of pendulum 21 may be limited by shock absorbers 51 or the mechanical interferences between the various elements. In addition, the resistance provided by shock absorbers 51 may be adjusted optionally to suit the user's individual exercise program. When the user desires to use machine 11 with pendulum 21 in an undampened, free-swinging state, shock absorbers may be repositioned in the upright secured position (FIG. 1) as described above.

The invention has several advantages. This machine uses a pendulum-like swing assembly instead of a horizontal rotating platform to simulate natural body motions. The foot support surfaces of the invention are linked to one another for coordinated, synchronized movement. Because the legs of the user swing in unison with the pendulum, the invention may be used for ski training due to the similar motions required for each. The resistance provided by the shock absorbers is adjustable and the device may also be used without the shock absorbers for rapid, free-swinging motion.

While the invention has been shown or described in only some of its forms, it should be apparent to those skilled in the art that it is not so limited, but is susceptible to various changes without departing from the scope of the invention.

We claim:

1. An exercise device, comprising:

a frame having an upper portion and two side portions extending from the upper portion;

a handle on each of the side portions adapted to be gripped by a user;

a pendulum having an upper end pivotally suspended from the upper portion of the frame intermediate between the two side portions and having a lower end which is free of contact with the frame and is laterally movable from side to side;

a support member mounted to the lower end of the pendulum and adapted to support the weight of a user while standing on the support member such that the weight of the user is transferred through the pendulum to the upper portion of the frame; and wherein the pendulum swings the support member laterally relative to the side portion in a vertical plane towards and away from the side portions of the frame under the influence of the user.

2. The device of claim 1, further comprising a mechanical dampener mounted between the pendulum and the support member for adding resistance to the motion of the pendulum.

3. The device of claim 2 wherein the mechanical dampener comprises a cylinder and a piston, wherein one of the cylinder and the piston is connected to the support member, and the other of the cylinder and the piston is connected to the pendulum.

4. The device of claim 1 wherein the pendulum comprises a pair of laterally spaced-apart bars, each of the bars having a lower end which is connected to the support member.

5. An exercise device, comprising:

a frame having an upper portion and two side portions extending from the upper portion;

a pendulum suspended from the upper portion of the frame and having a lower end which is free of contact with the frame and is laterally movable from side to side;

a support member mounted to the lower end of the pendulum and adapted to support the weight of a user while standing on the support member such that the weight of the user is transferred through the pendulum to the upper portion of the frame;

wherein the pendulum swings the support member laterally from side to side between the side portions of the frame under the influence of the user; and wherein the support member comprises:

a brace member mounted to the lower end of the pendulum;

a pair of laterally spaced-apart foot platforms rotatably coupled to the brace member; and a linkage member pivotally connected between each of the foot platforms and the pendulum for synchronizing movement between the foot platforms as the pendulum moves from side to side.

6. An exercise device, comprising:

a frame having an upper portion and a lower portion adapted to be supported on a floor;

a pendulum suspended from the upper portion of the frame and having a lower end which is spaced above and free of the lower portion of the frame and is laterally movable from side to side;

a pair of laterally spaced-apart foot supports, each rotatably mounted to the lower end of the pendulum, wherein the foot supports are adapted to support the weight of a user while standing with one foot on each of the foot supports such that the weight of the user is transferred through the pendulum to the upper portion of the frame; wherein the pendulum swings the foot supports laterally from side to side between the side portions of the frame under the influence of the user; and a linkage member pivotally connecting each of the foot supports to the frame which maintains the foot supports generally horizontal as the pendulum swings side to side.

7. The device of claim 6, further comprising a mechanical dampener mounted between the pendulum and each of the foot supports for adding resistance to the motion of the pendulum.

8. The device of claim 7 wherein each of the mechanical dampeners comprises a cylinder and a piston, wherein one of the cylinder and the piston is connected to one of the foot supports, and the other of the cylinder and the piston is connected to the pendulum.

9. The device of claim 6 wherein the pendulum comprises a pair of laterally spaced-apart, vertical bars suspended from the upper portion of the frame, each of the vertical bars having a lower end which is fixed from movement relative to the other.

10. The device of claim 6 wherein the foot supports comprise:

a brace member mounted to the lower end of the pendulum, wherein the foot supports are rotatably coupled to the brace member.

11. The device of claim 6 wherein the foot supports are substantially parallel to one another while in a central stationary position.

12. An exercise device, comprising:

a frame having an upper portion and two side portions;

a handle mounted to each of the side portions;

a pendulum suspended from the upper portion and having a pair of laterally spaced-apart bars, each of the bars having a lower end which is free of contact with the frame and is laterally movable from side to side;

a support member having a brace mounted to the lower ends of the bars, a pair of laterally spaced-apart foot platforms rotatably coupled to the brace, and a linkage member pivotally connected between each of the foot platforms and the bars for synchronizing movement between the foot platforms as the pendulum moves from side to side, the support member being adapted to support the weight of a user while standing on the support member such that the weight of the user is transferred through the pendulum to the upper portion of the frame;

a mechanical dampener mounted between the pendulum and the support member for adding resistance to the motion of the pendulum; and wherein The pendulum swings the support member laterally from side to side between the side portions of the frame under the influence of the user.

13. The device of claim 12 wherein the mechanical dampener comprises a cylinder and a piston, wherein one of the cylinder and the piston is connected to the support member, and the other of the cylinder and the piston is connected to the pendulum.

* * * * *